US011998806B2

(12) United States Patent
Wang

(10) Patent No.: US 11,998,806 B2
(45) Date of Patent: Jun. 4, 2024

(54) BALL FOR COMPETITIONS AND TOY GAMES

(71) Applicant: Lei Wang, Chuzhou (CN)

(72) Inventor: Lei Wang, Chuzhou (CN)

( * ) Notice: Subject to any disclaimer, the term of this patent is extended or adjusted under 35 U.S.C. 154(b) by 0 days.

(21) Appl. No.: 17/883,796

(22) Filed: Aug. 9, 2022

(65) Prior Publication Data

US 2024/0050811 A1 Feb. 15, 2024

(51) Int. Cl.
*A63B 43/00* (2006.01)

(52) U.S. Cl.
CPC ..... *A63B 43/008* (2013.01); *A63B 2225/74* (2020.08)

(58) Field of Classification Search
CPC .... A63B 43/008; A63B 2225/74; A63B 43/06
See application file for complete search history.

(56) References Cited

U.S. PATENT DOCUMENTS 5,054,778 A * 10/1991 Maleyko ..... H05B 45/00 446/485
5,228,686 A * 7/1993 Maleyko ..... A63B 43/06 273/DIG. 8
5,639,076 A * 6/1997 Cmiel ..... H03K 3/0231 446/485
5,669,702 A * 9/1997 Wang ..... F21V 3/023 446/485
5,779,575 A * 7/1998 Hsieh ..... A63B 43/06 473/570
5,888,156 A * 3/1999 Cmiel ..... A63B 43/06 473/570
8,517,869 B2 * 8/2013 Steidle ..... A63B 43/00 473/570
10,159,874 B1 * 12/2018 Lin ..... A63B 37/12
10,258,836 B2 * 4/2019 Molinari ..... A63B 43/06
2005/0261091 A1 * 11/2005 Buschfort ..... A63B 41/08 473/570
2008/0274844 A1 * 11/2008 Ward ..... A63B 43/00 200/80 R
2011/0136604 A1 * 6/2011 Hsu ..... A63B 41/00 473/609

(Continued)

FOREIGN PATENT DOCUMENTS

CN 107158667 A * 9/2017 ..... A63B 41/00
KR 20120019793 A * 7/2012

*Primary Examiner* — Steven B Wong
(74) *Attorney, Agent, or Firm* — Birchwood IP

(57) ABSTRACT

The present application relates to the technical field of rubber balls, specifically discloses a ball for competitions and toy games, wherein a power supply installation groove is arranged on the ball body, and a sealing plug for sealing the power supply installation groove is arranged on the power supply installation groove, in which a power supply module is arranged, the power supply module comprises a power supply and a power supply contact arranged at bottom of the power supply, wherein a flexible LED light strip is pasted on an inner side of the ball body in a ring shape, and the flexible LED light strip is provided with a light strip contact, wherein the light strip contact is arranged below the power installation groove. The flexible LED is attached to the inner side of the ball body in a ring shape, so that the ball body emits light more uniformly.

6 Claims, 5 Drawing Sheets

(56) References Cited

U.S. PATENT DOCUMENTS

| | | | | |
|---|---|---|---|---|
| 2015/0159858 | A1* | 6/2015 | Lin | F21K 9/61<br>362/311.01 |
| 2016/0310803 | A1* | 10/2016 | Yu | A63B 43/06 |
| 2016/0354646 | A1* | 12/2016 | Wang | A63B 43/06 |
| 2018/0043218 | A1* | 2/2018 | Hu | A63B 41/00 |
| 2022/0203177 | A1* | 6/2022 | Sundquist | A63B 43/06 |

* cited by examiner

BALL FOR COMPETITIONS AND TOY GAMES

TECHNICAL FIELD

The present application relates to the technical field of rubber balls, and specifically discloses a ball for competitions and toy games.

BACKGROUND

There are quite a few types of ball games, and they have always been loved by many sports enthusiasts. Ball games can not only exercise the body, but also cultivate the interaction between people. Generally speaking, most of the ball designs are guided by the shape or elastic function design, and other functional designs are rarely added, so the appearance of commercially available balls is roughly the same.

There are light-emitting ball bodies on the market. Chinese Patent No. CN201620330206.5 discloses a light-emitting LED ball, which relates to the technical field of toy rubber balls, comprising an inner layer, a middle layer, an outer layer and a light-emitting LED module, the inner layer is a transparent bladder, the middle layer is a mesh layer, the outer layer is a rubber layer, and the outer layer is adhered to the inner layer through the middle layer. The light-emitting LED module comprises an LED lamp, a transparent lampshade, a switch and a battery, the LED lamp is arranged in the inner layer, the battery supplies power to the LED lamp, the opening of the transparent lampshade is fixed on the inner layer and the middle layer, and is covered outside the LED lamp, and the switch controls the connection between the battery and the LED lamp. The invention has simple structure, low manufacturing cost and simple assembly, greatly increases the entertainment of the ball toy, and has good practicability and promotion prospects.

The above-mentioned published patent has the following technical problems:

1. The light-emitting LED module adopts LED lights, and the light-emitting LED module adopts point-type light-emitting distribution inside the ball body, and the light-emitting of the ball body is uneven.

2. The light-emitting LED module adopts point-type light-emitting distribution inside the ball body, a single light-emitting LED module needs to be provided with a corresponding power supply, so a plurality of power supplies need to be used, and it is cumbersome to replace the power supply;

3. In the light-emitting ball body disclosed in the patent, when the battery is dead, the sphere stops emitting light, and the ball body cannot emit light by itself.

SUMMARY

The technical solution adopted by the present application for solving the above problems is as follows:

The present invention provides a ball for competitions and toy games, comprising:

a ball body, on which a power supply installation groove is arranged, wherein a sealing plug for sealing the power supply installation groove is arranged on the power supply installation groove;

a single power supply module, arranged in an inner side of the power supply installation groove, wherein the power supply module comprises a power supply and a power supply contact arranged at bottom of the power supply;

a flexible LED light strip, pasted on an inner side of the ball body in a ring shape, and the flexible LED light strip is provided with a light strip contact, wherein the light strip contact is arranged below the power installation groove.

Further, the ball body is provided with a plurality of skins, a plurality of grooves are formed between the skins, and a pattern is provided on the skin, and the groove and an inner side of the pattern are coated with luminescent powder.

Further, one end of the power installation groove close to the sealing plug is provided with a plurality of waterproof baffles, and the waterproof baffles are annularly distributed on an inner wall of the power supply installation groove, wherein the waterproof baffle and bottom of the sealing plug are in an interference fit, when the sealing plug is arranged in the power supply installation groove.

Further, the power supply contact is configured in a groove shape, the light strip contact is configured in a convex shape, and the light strip contact and the power supply contact are mutually clamped.

Further, the sealing plug is fixed on the power supply installation groove by a threaded connection.

Further, the ball body is composed of a rubber layer, a suture layer and a liner layer in sequence from the outside to the inside, and the flexible LED light strip is pasted on an inner wall of the liner layer, and the power supply installation groove passes through the rubber layer, the suture layer and the liner layer.

Further, the ball is any one of football, volleyball, rugby and playground ball.

The beneficial effects of the present invention are: The present invention provides a ball for competitions and toy games, wherein a power supply installation groove is arranged on the ball body, and a sealing plug for sealing the power supply installation groove is arranged on the power supply installation groove, in which a power supply module is arranged, the power supply module comprises a power supply and a power supply contact arranged at bottom of the power supply, wherein a flexible LED light strip is pasted on an inner side of the ball body in a ring shape, and the flexible LED light strip is provided with light strip contacts, wherein the light strip contact is arranged below the power installation groove. The flexible LED is attached to the inner side of the ball body in a ring shape, so that the ball body emits light more uniformly. A single group of power supply is used to supply power to the light strip, which makes it convenient to replace the power supply. The ball body is coated with luminescent powder, and the light strip illuminates the area coated with the luminescent powder. When the power is turned off, the ball body can continue to emit light through the luminescent powder.

Reference signs:

1—Ball body, 101—Rubber layer, 102—Suture layer, 103—Liner layer, 104—Flexible LED light strip, 1041—Light strip contact, 105—Power supply installation groove, 2—Power supply module, 3—Skin, 4—Outer surface of the ball body, 5—Pattern, 6—Groove, 7—Power supply, 701—Power supply contact, 8—Sealing plug, 9—Waterproof baffle.

DETAILED DESCRIPTION

In order to make those skilled in the art better understand the technical solutions of the present application, the technical solutions in the embodiments of the present application will be clearly and completely described below with reference to the accompanying drawings in the embodiments of the present application. Obviously, the described embodiments are only a part of the embodiments of the present application, but not all of the embodiments. Based on the embodiments of the present application, all other embodiments obtained by those skilled in the art without creative work fall within the protection scope of the present application.

Figure 1:
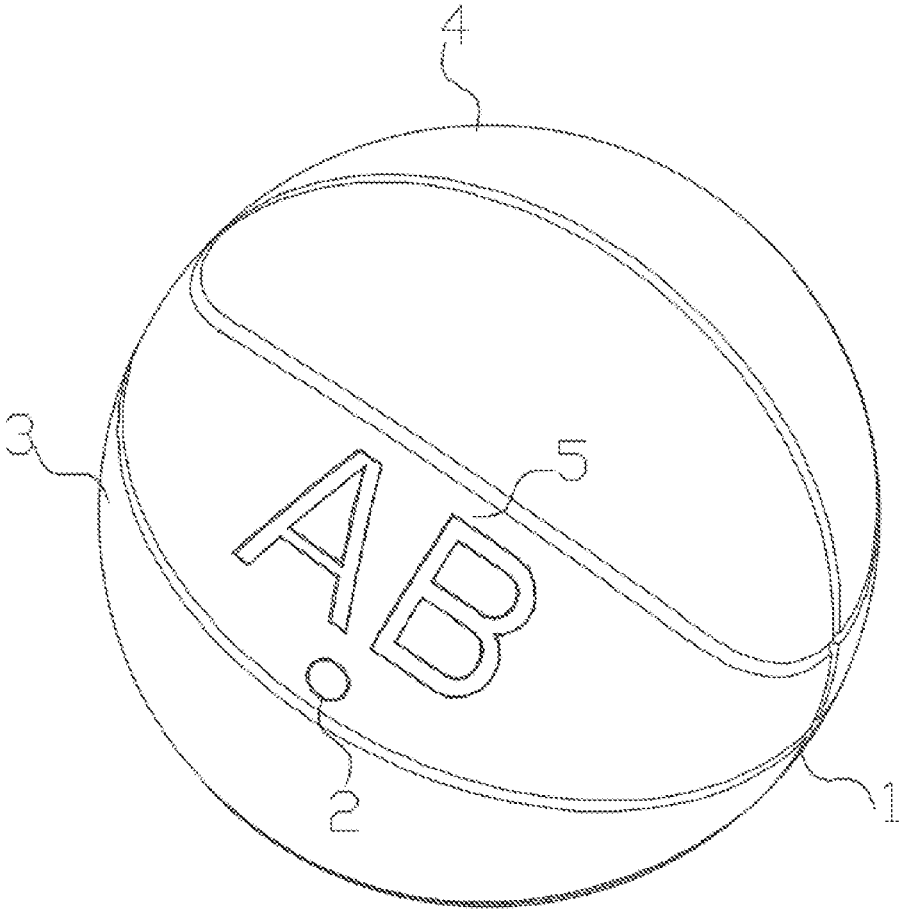
FIG. 1 is a perspective view of a ball for competitions and toy games according to the present application.
Figure 2:
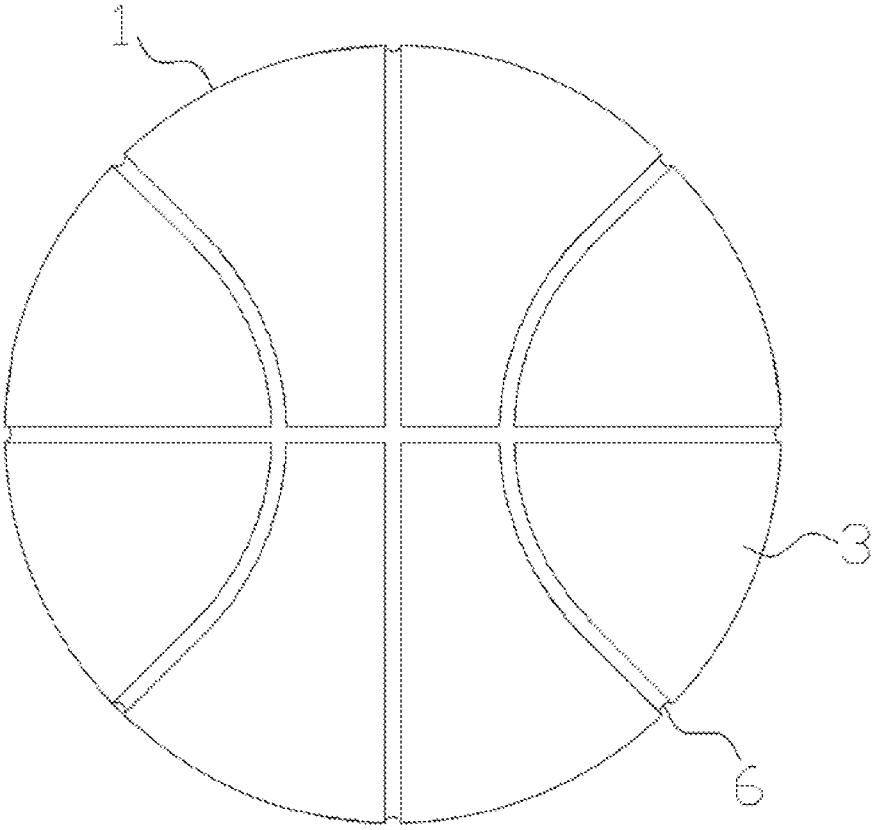
FIG. 2 is a side view of a ball for competitions and toy games according to the present application.
Figure 3:
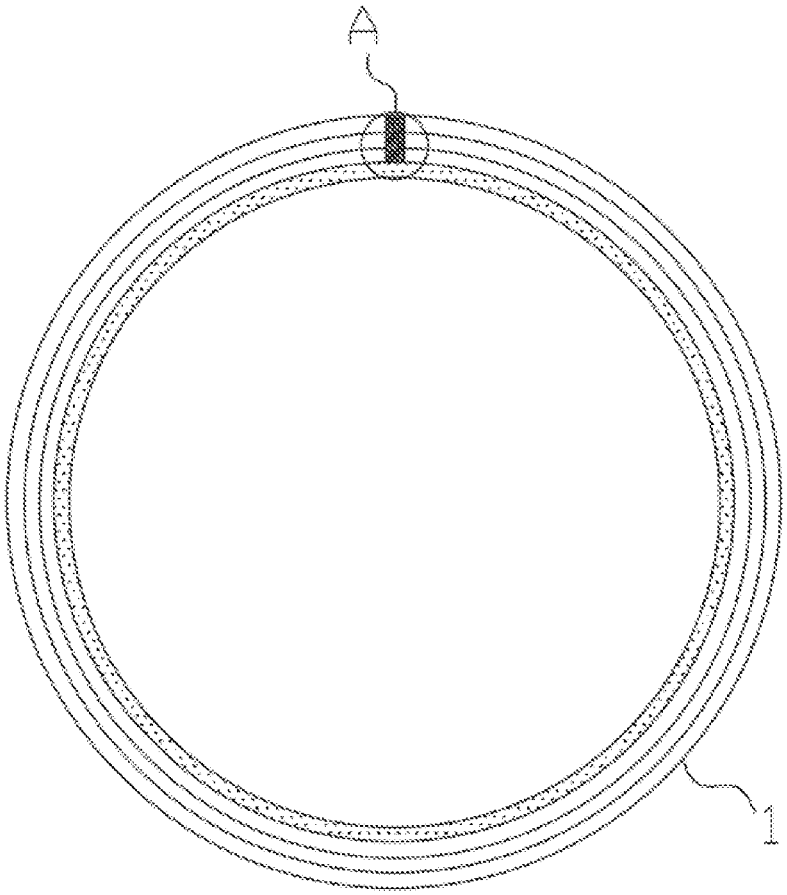
FIG. 3 is a sectional view of a ball for competitions and toy games according to the present application.
Figure 4:
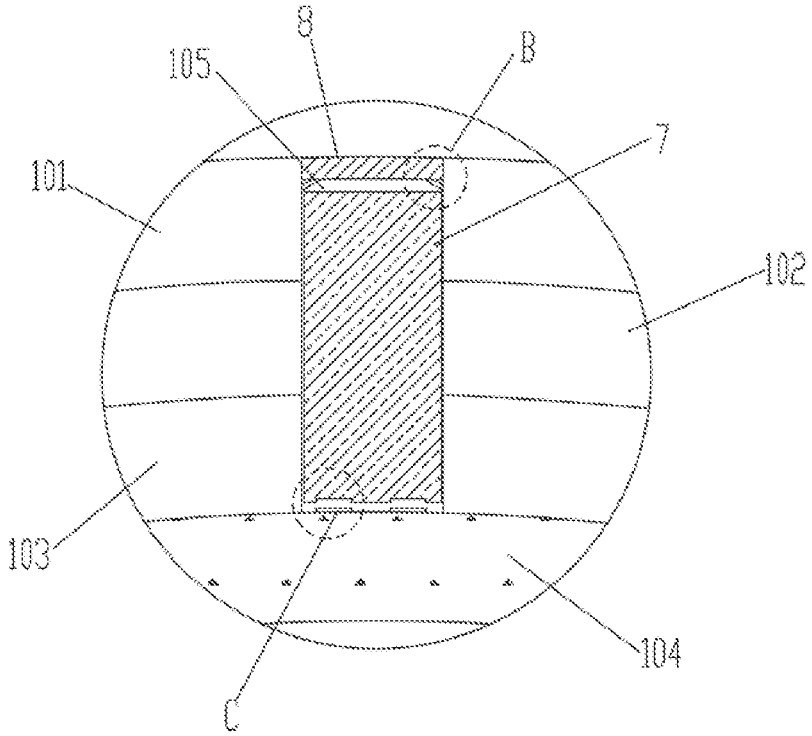
FIG. 4 is an enlarged view at A in the sectional view of a ball for competitions and toy games according to the present application shown in FIG. 3.
Figure 5:
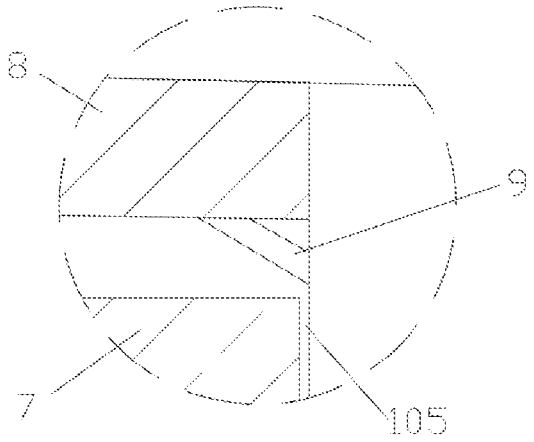
FIG. 5 is an enlarged view of B shown in FIG. 4.
Figure 6:
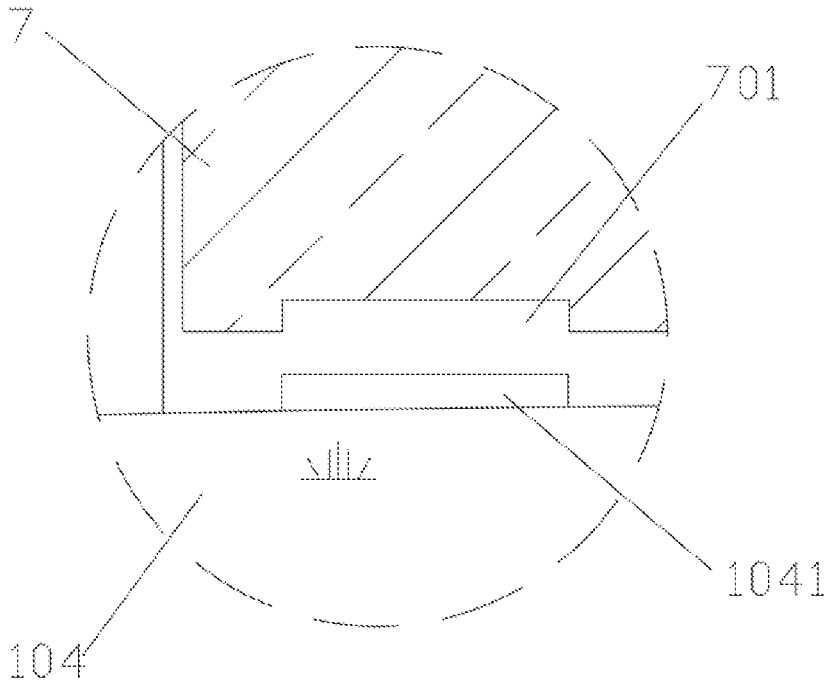
FIG. 6 is an enlarged view of C shown in FIG. 5.

Referring to the accompanying FIGS. 1-6 of the specification, a ball for competitions and toy games comprises a ball body 1, on which a power supply installation groove 105 is arranged, wherein a sealing plug 8 for sealing the power supply installation groove 105 is arranged on the power supply installation groove 105; a single power supply module 2, arranged in an inner side of the power supply installation groove 105, wherein the power supply module 2 comprises a power supply 7 and a power supply contact 701 arranged at bottom of the power supply 7; a flexible LED light strip 104, pasted on an inner side of the ball body 1 in a ring shape, and the flexible LED light strip 104 is provided with a light strip contact 1041, wherein the light strip contact 1041 is arranged below the power installation groove 105. The flexible LED 104 is attached to the inner side of the ball body 1 in a ring shape, so that the ball body 1 emits light more uniformly. A single group of power supply is used to supply power to the light strip, which makes it convenient to replace the power supply.

As a preferred implementation of this embodiment, the ball body 1 is provided with a plurality of skins 3, a plurality of grooves 6 are formed between the skins 3, and a pattern 5 is provided on the skin 3, and the groove 6 and an inner side in of the pattern 6 are coated with luminescent powder. The ball body 1 is coated with luminescent powder, and the light strip illuminates the area coated with the luminescent powder. When the power is turned off, the ball body can continue to emit light through the luminescent powder.

Specifically, one end of the power installation groove 105 close to the sealing plug 8 is provided with a plurality of waterproof baffles 9, and the waterproof baffles 9 are annularly distributed on an inner wall of the power supply installation groove 105, wherein the waterproof baffle 9 and bottom of the sealing plug 8 are in an interference fit, when the sealing plug 8 is arranged in the power supply installation groove105. The waterproof baffle 9 and the bottom of the sealing plug 8 further waterproof the power supply 7.

Specifically, the power supply contact 701 is configured in a groove shape, the light strip contact 1041 is configured in a convex shape, and the light strip contact 701 and the power supply contact 1041 are mutually clamped. The power supply 7 and the flexible LED light strip 104 are in contact with each other through the contacts, which makes the installation more convenient, and the contacts are not easily displaced.

As a preferred implementation of this embodiment, the sealing plug 8 is fixed on the power supply installation groove 105 by a threaded connection. The threaded connection has high stability, and the threaded connection guarantees the waterproofness of the sealing plug.

Specifically, the ball body 1 is composed of a rubber layer 101, a suture layer 102 and a liner layer 103 in sequence from the outside to the inside, and the flexible LED light strip 104 is pasted on an inner wall of the inner layer 103, and the power supply installation groove 105 passes through the rubber layer 101, the suture layer 102 and the liner layer 103.

Furthermore, the ball is any one of football, volleyball, rugby and playground ball.

From the above description, it can be seen that the above-mentioned embodiments of the present invention achieve the following technical effects:

The present invention provides a ball for competitions and toy games, wherein a power supply installation groove is arranged on the ball body, and a sealing plug for sealing the power supply installation groove is arranged on the power supply installation groove, in which a power supply module is arranged, the power supply module comprises a power supply and a power supply contact arranged at bottom of the power supply, wherein a flexible LED light strip is pasted on an inner side of the ball body in a ring shape, and the flexible LED light strip is provided with light strip contacts, wherein the light strip contact is arranged below the power installation groove. The flexible LED is attached to the inner side of the ball body in a ring shape, so that the ball body emits light more uniformly. A single group of power supply is used to supply power to the light strip, which makes it convenient to replace the power supply. The ball body is coated with luminescent powder, and the light strip illuminates the area coated with the luminescent powder. When the power is turned off, the ball body can continue to emit light through the luminescent powder.

It should be noted that the technical terms used herein is for the purpose of describing specific embodiments only, and is not intended to limit the exemplary embodiments according to the present application. As used herein, the singular forms are also intended to include the plural forms unless the context clearly dictates otherwise. In addition, it should also be understood that when the terms "comprising" and/or "including" are used in this specification, they indicate the presence of features, steps, operations, devices, components, and/or combinations thereof.

What is claimed is:

1. A ball for competitions and toy games, comprising:

a ball body, on which a power supply installation groove is arranged, wherein a sealing plug for sealing the power supply installation groove is arranged on the power supply installation groove;

a single power supply module, arranged in an inner side of the power supply installation groove, wherein the power supply module comprises a power supply and a power supply contact arranged at bottom of the power supply;

a flexible LED light strip, pasted on an inner side of the ball body in a ring shape, and the flexible LED light strip is provided with a light strip contact, wherein the light strip contact is arranged below the power installation groove;

wherein the ball body is provided with a plurality of skins, a plurality of grooves are formed between the skins, and a pattern is provided on the skin, and the plurality of grooves and an inner side of the pattern are coated with luminescent powder.

2. The ball for competitions and toy games according to claim 1, wherein one end of the power installation groove close to the sealing plug is provided with a plurality of waterproof baffles, and the waterproof baffles are annularly distributed on an inner wall of the power supply installation groove, wherein the waterproof baffle and bottom of the sealing plug are in an interference fit, when the sealing plug is arranged in the power supply installation groove.

3. The ball for competitions and toy games according to claim 2, wherein the power supply contact is configured in a groove shape, the light strip contact is configured in a convex shape, and the light strip contact and the power supply contact are mutually clamped.

4. The ball for competitions and toy games according to claim 3, wherein the sealing plug is fixed on the power supply installation groove by a threaded connection.

5. The ball for competitions and toy games according to claim 4, wherein the ball body is composed of a rubber layer, a suture layer and a liner layer in sequence from the outside to the inside, and the flexible LED light strip is pasted on an inner wall of the liner layer, and the power supply installation groove passes through the rubber layer, the suture layer and the liner layer.

6. The ball for competitions and toy games according to claim 1, wherein the ball is any one of football, volleyball, rugby and playground ball.

* * * * *